US007514697B2

(12) United States Patent
Schindlbeck et al.

(10) Patent No.: US 7,514,697 B2
(45) Date of Patent: Apr. 7, 2009

(54) STORAGE PHOSPHOR PLATE FOR THE STORAGE OF X-RAY INFORMATION

(75) Inventors: Günther Schindlbeck, München (DE); Olaf Klabunde, Giengen/Brenz (DE)

(73) Assignee: Agfa-Gevaert HealthCare GmbH, Leverkusen (DE)

( * ) Notice: Subject to any disclaimer, the term of this patent is extended or adjusted under 35 U.S.C. 154(b) by 0 days.

(21) Appl. No.: 11/112,639

(22) Filed: Apr. 22, 2005

(65) Prior Publication Data

US 2005/0260517 A1 Nov. 24, 2005

(30) Foreign Application Priority Data

May 21, 2004 (EP) ..... 04102247

(51) Int. Cl.
*G03C 5/16* (2006.01)

(52) U.S. Cl. ..... 250/484.4; 428/102

(58) Field of Classification Search ..... 250/484.4; 428/102

See application file for complete search history.

(56) References Cited

U.S. PATENT DOCUMENTS

| | | | | |
|---|---|---|---|---|
| 4,825,085 | A * | 4/1989 | Tsuchino et al. | 250/484.4 |
| 4,906,506 | A * | 3/1990 | Nishimura et al. | 428/113 |
| 5,100,713 | A * | 3/1992 | Homma et al. | 428/102 |
| 5,145,734 | A * | 9/1992 | Ito et al. | 442/187 |
| 5,441,251 | A | 8/1995 | Ohta | |
| 5,783,278 | A * | 7/1998 | Nishimura et al. | 428/102 |
| 6,373,074 | B1 | 4/2002 | Mueller et al. | |
| 6,388,266 | B1 * | 5/2002 | Muller | 250/588 |
| 6,501,088 | B1 | 12/2002 | Struye et al. | |
| 2002/0130272 | A1 | 9/2002 | Sauvage et al. | |
| 2002/0166977 | A1 * | 11/2002 | Kohda et al. | 250/484.4 |
| 2003/0010944 | A1 * | 1/2003 | Yasuda | 250/584 |
| 2003/0118156 | A1 | 6/2003 | Stahl et al. | |
| 2003/0128815 | A1 | 7/2003 | Stahl et al. | |
| 2004/0041100 | A1 | 3/2004 | Maezawa et al. | |
| 2004/0051438 | A1 * | 3/2004 | Leblans et al. | 313/467 |
| 2004/0146703 | A1 * | 7/2004 | Nakano et al. | 428/292.1 |
| 2004/0159801 | A1 * | 8/2004 | Kishinami et al. | 250/484.4 |
| 2004/0168900 | A1 | 9/2004 | Tung | |
| 2006/0249709 | A1 * | 11/2006 | Nakamura | 252/301.4 F |

FOREIGN PATENT DOCUMENTS

| | | | |
|---|---|---|---|
| EP | 1065524 | A2 * | 1/2001 |
| EP | 1324117 | | 7/2003 |
| EP | 1324118 | | 7/2003 |
| EP | 1385050 | | 1/2004 |
| EP | 1396864 | | 3/2004 |
| EP | 1435628 | | 7/2004 |

* cited by examiner

*Primary Examiner*—David P Porta
*Assistant Examiner*—Djura Malevic
(74) *Attorney, Agent, or Firm*—Houston Eliseeva, LLP

(57) ABSTRACT

A storage phosphor plate includes: a storage phosphor layer for the storage of X-ray information; and a substrate layer onto which the storage phosphor layer is applied. The substrate layer includes a fibre composite which is made from a synthetic material reinforced with fibres in the form of a woven fabric.

18 Claims, 1 Drawing Sheet

STORAGE PHOSPHOR PLATE FOR THE STORAGE OF X-RAY INFORMATION

FIELD OF THE INVENTION

The invention relates to a storage phosphor plate for the storage of X-ray information and a corresponding read-out unit for reading out the X-ray information stored in the storage phosphor plate.

BACKGROUND OF THE INVENTION

X-ray pictures can be stored in so-called storage phosphors, whereby X-ray radiation passing through an object, for example a patient, is stored as a latent picture in a phosphor layer. In order to read out the latent picture, the phosphor layer is irradiated with stimulation light, and so stimulated into emitting emission light. The emission light, the intensity of which corresponds to the picture stored in the phosphor layer, is collected by an optical detector and converted into electric signals. The electric signals are further processed, as required, and finally made available for examination, in particular for medical/diagnostic purposes, whereby they are displayed in corresponding display equipment, such as eg. a monitor or a printer.

Storage phosphor plates are known from the prior art, whereby a storage phosphor layer is applied onto an aluminium substrate layer. With these storage phosphor plates, the evenness of the storage phosphor plate which is required for certain applications, can not always be guaranteed. For example, permanent deformation of the substrate layer can occur as a result of small bends or impacts, and these effect accuracy when reading out the X-ray information stored in the storage phosphor layer.

It is the aim of the invention to provide a storage phosphor plate which offers the highest possible degree of evenness, in particular following bends or impacts, with at the same time, a high level of mechanical flexibility.

SUMMARY OF THE INVENTION

The above and other problems are solved by a storage phosphor plate having: a storage phosphor layer for the storage of X-ray information; and a substrate layer onto which the storage phosphor layer is applied. The substrate layer includes a fibre composite which is made from a synthetic material reinforced with fibres in the form of a woven fabric.

The invention is based on the idea of using a synthetic layer reinforced with fibres as a substrate layer, whereby the fibres are embedded into the synthetic material in the form of a woven fabric. By using a fabric, such as woven fibres or yarns as opposed to unwoven fibres (eg. felt or fleece type fibre plates), a high level of rigidity and also evenness of the substrate layer is achieved, with at the same time a high level of mechanical flexibility.

By using the woven fabric which extends over the whole surface of the substrate layer, reinforcement of the synthetic material is achieved over the whole substrate layer. The resulting substrate layer has a high degree of evenness over its whole surface, with a high level of mechanical flexibility. In particular, the storage phosphor plate is exceptionally resistant to damage or permanent deformation resulting from bending or impact.

The preferred synthetic material used for the substrate layer is a synthetic resin. For this purpose, epoxy, silicone, melamine, phenolic, polyimide or polyester resins or the like are particularly suitable. The fabric is preferably woven from synthetic fibres, such as glass, synthetic, aramid or polyester fibres.

In order to produce substrate layers with a particularly high level of rigidity on the one hand, and mechanical flexibility on the other hand, the fibre composite is preferably formed from an epoxy resin reinforced with a fabric made from glass fibres or carbon fibres.

In the case of an epoxy resin reinforced with a fabric made from glass fibres, the following types of fibre composites are particularly preferred, for example due to their elasticity modulus and also their bending strength and impact resistance:

1) Hgw 2372, Hgw 2372.1, Hgw 2372.4 or Hgw 2372.4H in accordance with German standard DIN 7735; or
2) G10, G11 or FR4 in accordance with US standard NEMA L1.

Preferably, the fibres or yarns of the fabric are woven in linen weave. Due to the linen weave of the fabric used, an exceptionally isotropic, ie. direction-independent mechanical reinforcement of the synthetic material used for the substrate layer can be achieved. In this way, a high degree of evenness of the storage phosphor plate is guaranteed to the same extent in both directions of the plate surface.

Another preferred embodiment of the storage phosphor plate proposes that the substrate layer has a desired thickness of between approx. 0.1 mm and 4 mm. Within this desired thickness range, a sufficiently high level of flexibility, and at the same time, a high level of rigidity, is guaranteed for many applications. In special cases, these properties are achieved in a desired thickness range of between approx. 0.5 mm and 2 mm.

It is also preferred that at least one surface of the substrate layer has thickness variations of less than ±100 μm in relation to a desired thickness. In this way, the high level of rigidity of the substrate layer achieved in accordance with the invention is combined with a smooth surface quality, and this leads to a very high level of evenness of the storage phosphor layer applied onto the substrate layer. With thickness variations of less than ±20 μm, not only is a particularly high degree of evenness achieved, but also the advantage, that the storage phosphor layer can be applied onto the substrate layer with a particularly homogeneous thickness. A correspondingly high surface quality can, for example, already be achieved by compressing the substrate layer with correspondingly designed pressing tools, or subsequently, by burnishing and/or varnishing the surface.

The corresponding read-out unit used to read out the X-ray information stored in the storage phosphor plate includes the storage phosphor plate in accordance with the invention, a device for conveying and/or holding the storage phosphor plate in an essentially level position, and a reading head for reading out the X-ray information stored in the storage phosphor plate while the storage phosphor plate is conveyed and/or held in the essentially level position.

In comparison to the storage phosphor plates established by the prior art, the storage phosphor plate in accordance with the invention in such read-out units makes it possible to read out with a particularly high degree of accuracy and reliability because it is exceptionally insensitive to impacts or bending when it is removed from an X-ray cassette or during subsequent conveyance and/or holding of the storage phosphor plate during read-out. Even following extensive bending or jolting during handling of the storage phosphor plate, it takes on its originally even form once again, and can be read out with a high degree of accuracy.

Other features and advantages of the invention are detailed in the following description of preferred embodiments and possible applications, whereby reference is made to the attached drawings.

DETAILED DESCRIPTION OF THE PREFERRED EMBODIMENTS

Figure 1:
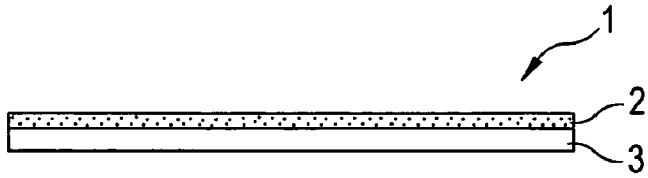
FIG. 1 shows a side view of a storage phosphor plate.

FIG. 1 shows a side view of a storage phosphor plate 1 whereby a storage phosphor layer 2 for the storage of X-ray information is applied onto a substrate layer 3.

Serving as the storage phosphor layer 2 can, for example, be storage phosphor particles bound in a binding agent on a base of halogenated barium fluoride compounds which are activated with europium (eg. $BaFBr_x1_{1-x}$: $Eu^{2+}$) or needle-shaped structures running essentially at right angles to the level of the substrate layer 3 on a base of caesium halide compounds activated with europium (CsX:Eu, X=F, Cl, Br, 1). Due to their structure, the corresponding storage phosphor layers are also called Powder Image Plates (PIP) or Needle Image Plates (NIP). Details on the production and properties of this type of storage phosphor layer can, for example, be found in European patent application EP 1 065 524 A2, herein incorporated by reference in its entirety for background information only.

In the case of Powder Image Plates, the storage phosphor layer 2 is generally stuck onto the substrate layer 3 by means of an adhesive layer (not illustrated).

With Needle Image Plates, on the other hand, the corresponding needle structures of the storage phosphor layer 2 are applied onto the substrate layer 3 by growing in a specifically controlled growth process. For this, an appropriate intermediate layer (not illustrated) is usually required between the storage phosphor layer 2 and the substrate layer 3, which is suitable as a carrier for the needle structures which are to be grown. This type of intermediate layer can be, for example, a thin coat of aluminium which is created, for example, by vaporization onto the substrate layer 3. The thickness of this intermediate layer is chosen such that the mechanical properties of the substrate layer 3 are not essentially effected, and it typically only measures a few micrometers.

Figure 2:
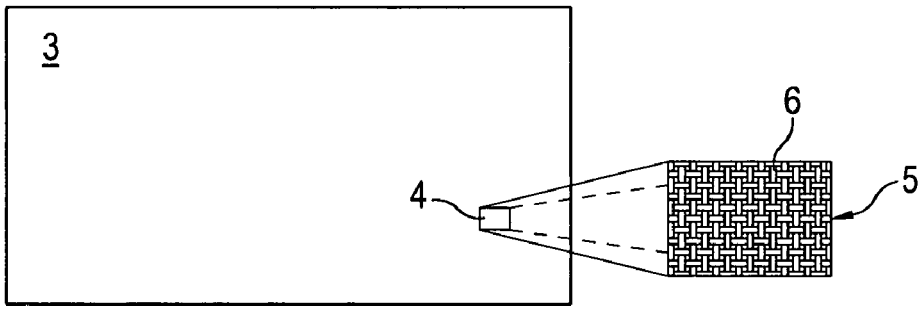
FIG. 2 shows a substrate layer of the storage phosphor plate shown in FIG. 1.

FIG. 2 shows an overhead view onto the substrate layer 3 of the storage phosphor plate illustrated in FIG. 1. The substrate layer 3 in accordance with the invention includes a synthetic material reinforced with a fabric. In order to demonstrate the invention, a square section 4 of the substrate layer 3 has been greatly enlarged. In this enlarged representation, one can see the fabric 5 which is woven from individual threads or yarns 6.

In the example illustrated, the fabric 5 has a so-called linen weave which makes it possible to create a particularly even reinforcement effect by means of the fabric 5 in both directions of the level of the substrate layer 3. Alternatively however, other forms of fabric can be used, such as twill, atlas, unidirectional or mock leno weaves.

Preferably, a so-called filament fabric is used as the fabric 5, whereby a yarn made up of a number of individual filaments is woven. Typical filament diameters are between approx. 5 and 10 μm, typical yarns typically contain between 1000 and 12000 filaments, and this corresponds to a yarn strength of between 1 K and 12 K.

Preferably, substrate layers in accordance with the invention are produced from fabric impregnated with synthetic resin, a so-called 'Prepreg', and this is hardened to make a corresponding fibre composite plate by applying heat and pressure.

In the following, two particularly advantageous embodiments of the storage phosphor plate in accordance with the invention will be described.

With a first embodiment, the substrate layer 3 used is a fibre composite made from a glass filament fabric and epoxy resin, in particular of the type Hgw 2372, Hgw 2372.1, Hgw 2372.4 or Hgw 2372.4H in accordance with the German standard DIN 7735 or G10, G11 or FR4 in accordance with the US standard NEMA L1. A storage phosphor layer 2 of the Powder Image Plate (PIP) type is applied, in particular stuck, onto a surface of the substrate layer 3. The advantage of this embodiment of the storage phosphor plate in accordance with the invention is that it is extremely rigid, is easy to produce and is of good optical quality.

With a second embodiment, a fibre composite made from carbon fibre fabric, in particular in a linen weave, and epoxy resin is used as the substrate layer 3. A intermediate layer made from aluminium which is several μm thick is applied, and in particular by vaporization, onto the substrate layer 3. The storage phosphor layer 2 of the Needle Image Plate (NIP) type is located on top of this middle layer. This storage phosphor plate 1 exhibits a high level of rigidity and particularly high optical quality. Moreover, it is sufficiently permeable for X-ray radiation, and it is therefore particularly suitable for taking mammographic X-rays, whereby the X-ray radiation passing through the breast tissue to be investigated and the X-ray cassette, including the storage phosphor plate, must be collected by a sensor, so as to make it possible to take an automatic application comparison measurement (the so-called Automatic Exposure Control).

Figure 3:
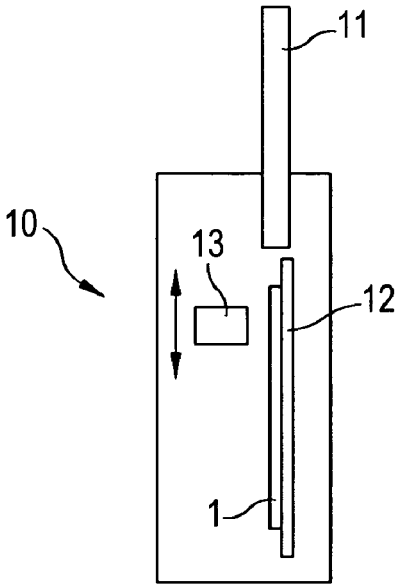
FIG. 3 shows a first read-out unit.

FIG. 3 shows a first read-out unit 10 for reading out the X-ray information stored in the storage phosphor plate 1. After an X-ray has been taken, the storage phosphor plate 1 is conveyed to the read-out unit in a light-sealed X-ray cassette 11. Prior to read-out, the X-ray cassette 11, along with the storage phosphor plate 1 which it contains, is introduced, at least partially, into the read-out unit 10. In this position, the storage luminescent material plate 1 is removed from the X-ray cassette 11 with a mechanism (not illustrated) and clamped onto a holding plate 12, as shown, for example, in FIG. 3.

This holding plate 12 is designed in such a way that it can grip the storage phosphor plate 1 eg. by form fit or frictional connection and/or by magnetic or electrostatic forces of attraction or negative pressure. Due to its high level of rigidity, the storage phosphor plate 1 here is extremely level.

A movable reading head 13 can now be moved over the storage phosphor plate 1 in the direction of movement indicated by a double arrow, and in this way collects the X-ray information stored in the plate. This movable reading head 13 is preferably in the form of a so-called line scanner, whereby, by means of a line light source, a whole line of the storage phosphor layer is respectively irradiated with stimulation light, and the emission light coming from this line is collected by a linear detector array. By successively reading out a number of individual lines in the direction of movement of the movable reading head 13, a two-dimensional picture of the X-ray information stored in the storage phosphor layer is finally obtained. Details on the structure and function of this type of line scanner can be found, for example, in the patent document U.S. Pat. No. 6,373,074 B1, herein incorporated by reference in its entirety for background information only.

Figure 4:
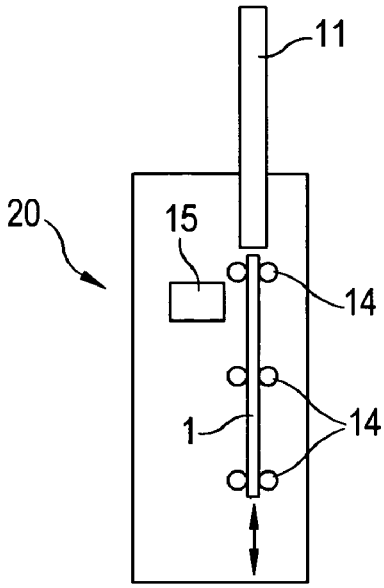
FIG. 4 shows a second read-out unit.

FIG. 4 shows a second read-out unit 20 for reading out the X-ray information stored in the storage phosphor plate 1. In this example too, an X-ray cassette 11, with a storage phosphor plate 1 located within it, is partially introduced into the read-out unit 20. The storage phosphor plate 1, in the case illustrated, has already been removed from the X-ray cassette 11 by means of appropriate removal devices, and introduced into a conveyance device 14 which can move the storage phosphor layer 1 past an upright reading head 15. The direction of movement of the storage phosphor layer 1 during read-out is indicated by a double arrow in FIG. 4.

Due to its high level of rigidity, the storage phosphor plate 1 in accordance with the invention maintains its level form, even if (as shown in this example) it is only supported at a few points by the conveyance device 14.

The upright reading head 15 can also, as already explained in connection with FIG. 3, be a line scanner. Alternatively, the upright reading head 15 can also be in the form of a so-called Flying Spot Scanner, whereby the stimulation light in the form of a laser beam is deflected by a rotating mirror in such a way, that the laser beam passes over the storage phosphor plate 1 along a line. In so doing, the emission light stimulated in the storage phosphor layer at specific intervals of time, and so dependent upon location, is collected at the same time. By successively reading out a number of individual lines as the storage phosphor plate 1 is correspondingly moved, a two-dimensional picture of the X-ray information stored in the storage phosphor layer is finally obtained. Details relating to this type of scanner are described, for example, in the patent document U.S. Pat. No. 6,501,088 B1, herein incorporated by reference in its entirety for background information only.

The invention claimed is:

1. A system for reading out X-ray information stored in a storage phosphor plate, the system comprising:

a storage phosphor plate comprising a storage phosphor layer for the storage of X-ray information; and a substrate layer onto which the storage phosphor layer is applied, said substrate layer comprising a fibre composite which is made from a synthetic material reinforced with fibres in the form of a woven fabric;

a device for conveying or holding the storage phosphor plate in an essentially planar position; and a reading head for reading out the X-ray information stored in the storage phosphor plate while the storage phosphor plate is being conveyed or held in the essentially planar position, wherein the device for conveying or holding the storage phosphor plate comprises a holding plate to which the storage phosphor plate is clamped and held in the essentially planar position; and wherein at least one surface of the fiber composite, to which the storage phosphor layer is applied, has thickness variations less than ±100 μm in relation to a desired thickness.

2. The system for reading out X-ray information stored in a storage phosphor plate in accordance with claim 1, wherein the synthetic material comprises a synthetic resin.

3. The system for reading out X-ray information stored in a storage phosphor plate in accordance with claim 2, wherein the synthetic resin comprises an epoxy, silicone, melamine, phenolic, polyimide or polyester resin.

4. The system for reading out X-ray information stored in a storage phosphor plate in accordance with claim 1, wherein the fabric is woven from synthetic fibres.

5. The system for reading out X-ray information stored in a storage phosphor plate in accordance with claim 4, wherein the woven fabric comprises glass, carbon, aramid or polyester fibres.

6. The system for reading out X-ray information stored in a storage phosphor plate in accordance with claim 1 wherein the fibre composite is formed from an epoxy resin reinforced with the woven fabric made from glass fibres or carbon fibres.

7. The system for reading out X-ray information stored in a storage phosphor plate in accordance with claim 1, wherein the fabric is in the form of a linen weave.

8. The system for reading out X-ray information stored in a storage phosphor plate in accordance with claim 1, wherein the substrate layer as a thickness between 0.1 mm and 4 mm.

9. The system for reading out X-ray information stored in a storage phosphor plate in accordance with claim 1, wherein at least one surface of the substrate layer has thickness variations less than ±20 μm in relation to a desired thickness.

10. The system for reading out X-ray information stored in a storage phosphor plate in accordance with claim 1, wherein the fibre composite has one of the following type identifications in accordance with US standard NEMA L1: G10, G11 or FR4.

11. The system for reading out X-ray information stored in a storage phosphor plate in accordance with claim 1, wherein the fabric is woven from a yarn which is made up from a number of filaments.

12. The system for reading out X-ray information stored in a storage phosphor plate in accordance with claim 11, wherein the filaments of the yarn have a diameter of between 5 and 10 μm.

13. The system for reading out X-ray information stored in a storage phosphor plate in accordance with claim 12, wherein the number of filaments in the yarn is between 1000 and 12000.

14. The system for reading out X-ray information stored in a storage phosphor plate in accordance with claim 1, wherein an intermediate layer made from aluminum is applied between the storage phosphor layer and the substrate layer.

15. A system in accordance with claim 1, wherein the storage phosphor plate is clamped onto the holding plate by form fit or frictional connection.

16. A system in accordance with claim 1, wherein the storage phosphor plate is clamped onto the holding plate by magnetic or electrostatic forces of attraction.

17. A system in accordance with claim 1, wherein the storage phosphor plate is clamped onto the holding plate by negative pressure.

18. A system in accordance with claim 1, wherein the reading head moves over the storage phosphor plate when reading out the X-ray information stored in the storage phosphor plate while the storage phosphor plate is clamped onto the holding plate and held in the essentially planar position.

* * * * *